United States Patent [19]

Proud et al.

[11] 4,427,923

[45] Jan. 24, 1984

[54] ELECTRODELESS FLUORESCENT LIGHT SOURCE

[75] Inventors: Joseph M. Proud, Wellesley Hills; Stephen G. Johnson, Georgetown, both of Mass.

[73] Assignees: GTE Laboratories Inc., Waltham, Mass.; GTE Products Corp., Stamford, Conn.

[21] Appl. No.: 307,556

[22] Filed: Oct. 1, 1981

[51] Int. Cl.[3] ..... H05B 41/16; H05B 41/24

[52] U.S. Cl. ..... 315/248; 313/637; 313/638; 315/39

[58] Field of Search ..... 315/248, 39; 313/227, 313/229, 637, 638, 639

[56] References Cited

U.S. PATENT DOCUMENTS

| | | | |
|---|---|---|---|
| 3,234,421 | 2/1966 | Reiling | 313/227 |
| 3,319,119 | 5/1967 | Rendina | 315/248 |
| 3,384,774 | 5/1968 | English | 313/227 |
| 3,384,775 | 5/1968 | Ishler et al. | 313/227 |
| 3,860,854 | 1/1975 | Hollister | 313/227 |
| 4,001,632 | 1/1977 | Haugesjaa et al. | 315/248 |
| 4,024,431 | 5/1977 | Young | 315/248 |
| 4,185,228 | 1/1980 | Regan | 315/248 |
| 4,266,166 | 5/1981 | Proud et al. | 315/248 |
| 4,360,758 | 11/1982 | Thornton, Jr. et al. | 313/227 |

*Primary Examiner*—Saxfield Chatmon, Jr.
*Attorney, Agent, or Firm*—David M. Keay

[57] ABSTRACT

An electrodeless fluorescent light source including an electrodeless lamp containing a metal iodide or iodine. A fluorescing material is disposed between the electrodeless lamp and an outer envelope. When the contents of the electrodeless lamp are excited by high frequency power, excited iodine atoms emit ultraviolet radiation. The ultraviolet radiation impinges on the fluorescing material causing it to emit visible light. The fluorescing material may be a solid phosphor material on the outer surface of the electrodeless lamp, a solid phosphor material on the inner surface of the outer envelope, a gaseous phosphor material in the space between the electrodeless lamp and the outer envelope, or some combination thereof.

23 Claims, 6 Drawing Figures

ELECTRODELESS FLUORESCENT LIGHT SOURCE

CROSS-REFERENCE TO RELATED APPLICATION

This invention is related to subject matter disclosed in application Ser. No. 307,419 filed concurrently herewith by Joseph M. Proud and Stephen G. Johnson entitled "Electrodeless Ultraviolet Light Source."

BACKGROUND OF THE INVENTION

This invention relates to electromagnetic discharge apparatus. More particularly, it is concerned with electrodeless fluorescent light sources.

Electrodeless light sources which operate by coupling high frequency power to an arc discharge in an electrodeless lamp have been developed. These light sources typically include a high frequency power source connected to a coupling fixture having an inner conductor and an outer conductor disposed around the inner conductor. The electrodeless lamp is positioned adjacent to the end of the inner conductor. High frequency power is coupled to a light emitting electromagnetic discharge within the electrodeless lamp. A portion of the coupling fixture passes radiation at the frequencies of light produced, this permitting the use of the apparatus as a light source.

Electrodeless fluorescent light sources are known in which the electrodeless lamp emits ultraviolet radiation which impinges on phosphors which in turn emit visible light when the ultraviolet radiation is absorbed. Examples of fluorescent light sources of this general type are disclosed in U.S. Pat. Nos. 4,119,889 to Donald D. Rollister, 4,005,330 to Homer H. Glascock, Jr. and John M. Anderson, 4,189,661 to Paul O. Haugsjaa and Edward F. White, and 4,266,167 to Joseph M. Proud and Donald H. Baird.

SUMMARY OF THE INVENTION

It is an object of the present invention to provide an improved electromagnetic discharge apparatus.

It is another object of the present invention to provide an electrodeless fluoresecent light source.

An improved fluorescent light source is provided by electromagnetic discharge apparatus in accordance with the present invention. The apparatus comprises an electrodeless lamp having an inner envelope of a substance transparent to ultraviolet radiation. The inner envelope encloses a fill material comprising a material selected from the group consisting of a metal iodide and iodine. Means are provided for coupling high frequency power to the fill material within the inner envelope to vaporize and excite the fill material thus producing ultraviolet radiation. An outer envelope of a substance transparent to visible light surrounds the inner envelope and is spaced from it. Fluorescing material which emits visible light upon absorption of ultraviolet radiation is disposd between the outer surface of the inner envelope and the inner surface of the outer envelope. Alternatively the apparatus may comprise an electrodeless lamp having an envelope enclosing a fill material comprising a material selected from the group consisting of a metal iodide and iodine with a coating of solid phosphor material which emits visible light adherent to the surface of the envelope.

The metal iodide or iodine provides a source of iodine atoms which are excited to a high energy state when high frequency power is applied. The excited iodine atoms emit ultraviolet radiation upon photon emission transition to a lower energy state. Further explanation of the manner in which the metal iodide or iodine produces ultraviolet radiation upon high frequency excitation is provided in the above-mentioned application of Proud and Johnson. The fluorescing material may be a gaseous phosphor material located in the space between the inner and outer envelopes, a solid phosphor material adherent either to the outer surface of the inner envelope or to the inner surface of the outer envelope, or a combination of gaseous and solid phosphor materials. The fluorescing material is excited by the ultraviolet radiation and in turn emits radiation in the visible light range.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
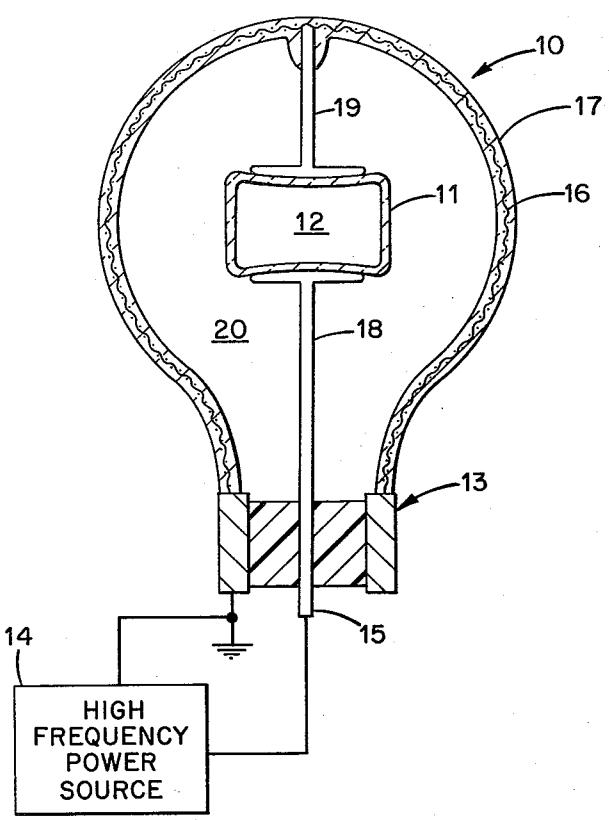
FIG. 1 is a schematic representation of an electrodeless radio frequency coupled discharge fluorescent light source in accordance with the present invention.

One embodiment of an electromagnetic discharge apparatus in accordance with the present invention is illustrated in FIG. 1. The apparatus 10 includes an electrodeless lamp 11 containing a fill material 12. The electrodeless lamp 11 is supported within a fixture 13 which couples power from a high frequency power source 14 to the fill material of the electrodeless lamp. The electrodeless lamp forms a termination load for the fixture.

The electrodeless lamp 11 has a sealed enveloped made of a suitable material which is transparent to ultraviolet radiation, for example, fused silica or aluminum oxide. The fill material 12 within the lamp envelope 11 includes a metal iodide or iodine. The metal iodide preferably may be either cadmium iodide mercuric iodide. A fill material of a metal iodide also contains a buffer gas, such as argon, xenon, neon, or nitrogen at a pressure of from 1 to 50 torr.

The coupling fixture 13 includes an inner conductor 15, and an outer conductor 16 disposed around the inner conductor. An outer envelope 17 of a material transparent to visible light surrounds and is spaced from the electrodeless lamp 11. The outer envelope 17 is appropriately sealed. The outer conductor 16 may be of conductive mesh so as to permit visible light to pass there-through, and may be contained within the outer envelope 17. The outer conductor 16 provides shielding at the operating frequencies while permitting the passage of light. The electrodeless lamp 11 is supported between a first metal electrode 18 at one end of the inner conductor 15 and a second metal electrode 19 connected to the outer conductor 16. The other ends of the inner and outer conductors are arranged in a coaxial configuration for coupling to the power source 14.

In order to achieve electrodeless discharge it is necessary to employ RF power capable of penetrating the lamp envelope while being absorbed strongly in the low pressure discharge plasma contained therein. The power source 14 preferably is a source of continuous wave RF excitation in those radio frequencies allocated for industrial, scientific, or medical usage located at 13.56, 27.12, 40.68, 915, or 2450 MHz. Most desirably, the RF frequency is in the range of from 902 to 928 MHz. However, useful frequencies lie within the range of from 1 MHz to 10 GHz. Structural details of electromagnetic discharge apparatus related to those illustrated schematically herein are disclosed in application Ser. No. 307,418 filed concurrently herewith by Joseph M. Proud, Robert K. Smith, and Charles N. Fallier entitled "Electromagnetic Discharge Appartus."

The space 20 between the inner envelope of the electrodeless lamp 11 and the outer envelope 17 contains a fluorescing material in the form of a gaseous phosphor. The gaseous phosphor composition must be such that it is chemically compatible with the materials forming the sealed space 20. The gaseous phosphor may be chosen from the mercury halides, preferably mercuric chloride and mercuric bromide. The mercury halides in the gaseous state absorb ultraviolet radiation and subsequently disassociate into a halide atom and an excited mercury-halide molecule. The excited mercury-halide molecule then fluoresces emitting visible light. The material thus exhibits the characteristics of a phosphor; a material which absorbs radiation at one wave length and fluoresces at some longer wave length.

As explained in the aforementioned application of Proud and Johnson when high frequency power is applied to the electrodeless lamp 11, a discharge is initiated in the gas which warms the contents of the lamp causing an increase in the iodide or iodine vapor pressure. Iodide or iodine molecules are dissociated in the discharge to yield iodine atoms. The iodine atoms are electronically excited to a high energy state and emit ultraviolet radiation at 206.2 nm upon photon emission transition to a lower state. Of course, additional emissions will be produced in the visible and ultraviolet portions of the spectrum from radiative transitions in I, $I_2$, Hg, $HgI_2$, HgI, Cd, $CdI_2$, CdI, etc. depending on the composition of the fill material. More than 10% of the applied RF power can be converted to ultraviolet radiation. The electrodeless lamp 11 thus provides a strong source of ultraviolet radiation which impinges on the gaseous phosphor in the space 20 causing it, in turn, to emit visible light.

Generally, it is required that the space 20 reach some equilibrium temperature during operation of the lamp for purposes of creating an appropriate vapor pressure of the gaseous phosphor material. The vapor pressure of the gaseous phosphor material should be sufficient to vaporize enough material so as to absorb the exciting ultraviolet radiation before it impinges on the outer envelope. Heating to temperatures in the range of 20° C. to 100° C. may be accomplished by dissipated radio frequency power from the space within the electrodeless lamp 11, and the subsequent transfer of heat from the inner envelope by conduction and infrared radiation to the space 20 and the outer envelope 17. The temperature attained at equilibrium depends upon a number of factors including the applied RF power level, the sizes of various elements of the apparatus, and the material composition of those elements.

Figure 2:
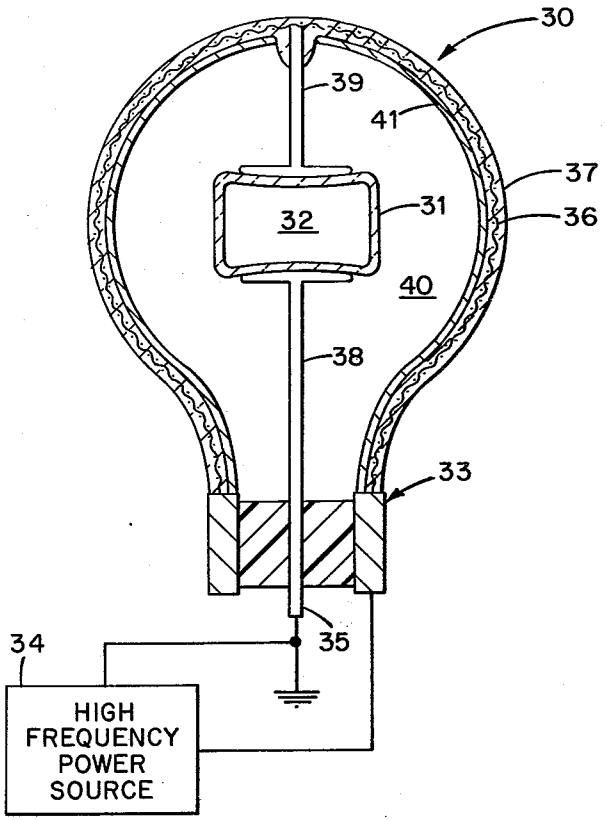
FIG. 2 is a schematic representation of a modification of the fluorescent light source of FIG. 1.

FIG. 2 illustrates an electromagnetic discharge apparatus 30 generally similar in physical structure to that of FIG. 1. The apparatus 30 includes an electrodeless lamp 31 having a fill material 32 of a metal iodide and a buffer gas or of iodine in accordance with the teachings of the Proud and Johnson application. An RF coupling fixture 33 has an inner conductor 35 and an outer mesh conductor 36 which is contained within an outer envelope 37 of a material which is transparent to visible light. The electrodess lamp 31 is supported by electrodes 38 and 39 from the inner and outer conductors, respectively, for applying RF power from a source 34 to the fill material within the electrodeless lamp 31. The fluorescing material is a layer of a solid phosphor material 41 which is adherent to the inner surface of the outer envelope 37. The solid phosphor may be any of the well-known phosphors widely employed in the fluorescent lighting industry. The space 40 between the inner and outer envelopes contains a vacuum or an inert gas; that is a material which does not absorb the ultraviolet radiation from the electrodeless lamp 31.

In an alternative arrangement of the apparatus 30 illustrated in FIG. 2 the space 40 between the inner and outer envelopes may contain a gaseous phosphor material. In order to provide effective efficient light producing operation the ultraviolet light radiated from the electrodeless lamp 31, the dimensions of the space 40, and the amount and characteristics of the gaseous and solid phosphor materials must be such that all the ultraviolet is not absorbed before it reaches and impinges upon the solid phosphor 41. In particular, the optical properties of the gaseous medium used and its density affect the results. The optical properties are largely determined by the vapor pressure in the space 40 and the operating temperature, as well as the cold spot temperature along the boundaries of the space 40.

Figure 3:
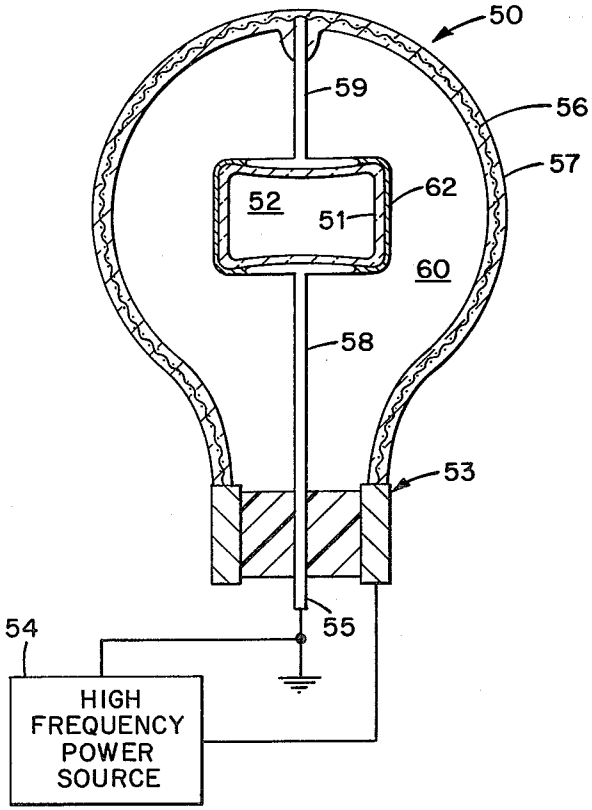
FIG. 3 is a schematic representation of another modification of the electrodeless light source of FIGS. 1 and 2.

FIG. 3 illustrates an electromagnetic discharge apparatus 50 having the same general structural configuration as those illustrated in FIGS. 1 and 2. The apparatus includes an electrodeless lamp 51 having a fill material 52 of a metal iodide or iodine whereby the lamp is a source of ultraviolet radiation. The electrodeless lamp 51 is mounted within an RF coupling fixture 53 having an inner conductor 55 and an outer conductor 56 supported within an outer envelope 57 which is transparent to visible light. The electrodeless lamp 51 is supported by electrodes 58 and 59 connected to the inner and outer conductors, respectively. The conductors 35, 36 are connected to a high frequency power source 54.

In this apparatus the fluorescing material is provided by a solid phosphor material 62 which is adherent to the outer surface of the inner envelope of the electrodeless lamp 51. The space 60 between the inner and outer envelopes advantageously contain a vacuum or an inert gas. The phosphor material 62 may be a standard lighting phosphor similar to that employed in the apparatus of FIG. 2.

Figure 4:
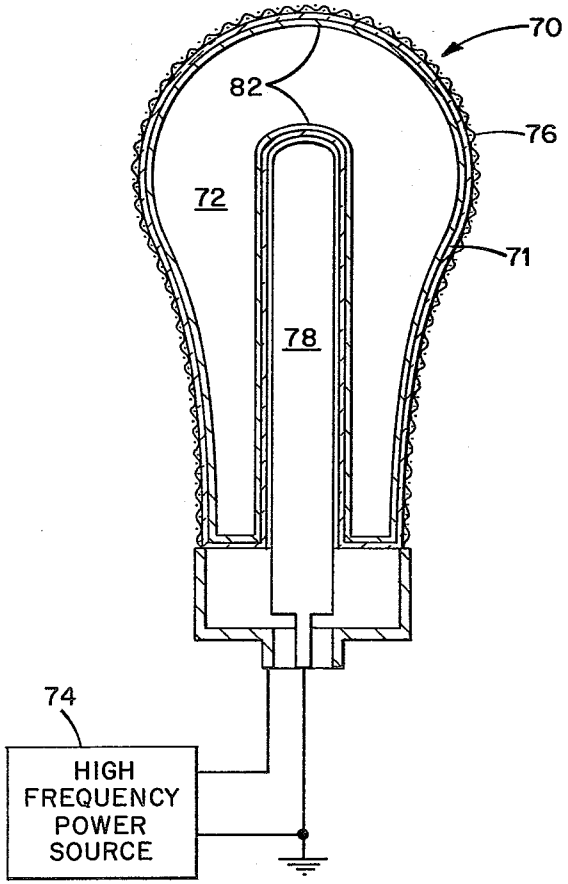
FIG. 4 is a schematic representation of an alternative form of an electrodeless fluorescent light source in accordance with the present invention.

FIG. 4 is a schematic representation of an alternative embodiment of an electromagnetic discharge apparatus 70 in accordance with the present invention. The apparatus 70 includes an electrodeless lamp 71 having a sealed envelope in the shape of a reentrant cylinder providing a generally annular discharge region 72. The fill material of the lamp within the space 72 includes a metal iodide or iodine as described hereinabove. The RF coupling arrangement includes a center electrode 78 disposed within the internal reentrant cavity in the envelope 71. An outer conductive mesh 76 encircles the envelope of the lamp 71 and the center electrode 78. The center electrode 78 and outer conductor 76 are coupled by a suitable coaxial arrangement to a high frequency power source 74. A radio frequency electric field is produced between the center electrode 78 and the mesh 76 causing ionization and breakdown of the fill material 72 which emits ultraviolet radiation. As indicated in FIG. 4 the fluorescing material is a solid phosphor material 82 adherent to the inner surface of the envelope of the lamp 71. Electromagnetic discharge apparatus related to that shown in FIG. 4 is described in U.S. Pat. No. 4,266,167 to Proud and Baird.

Figure 5:
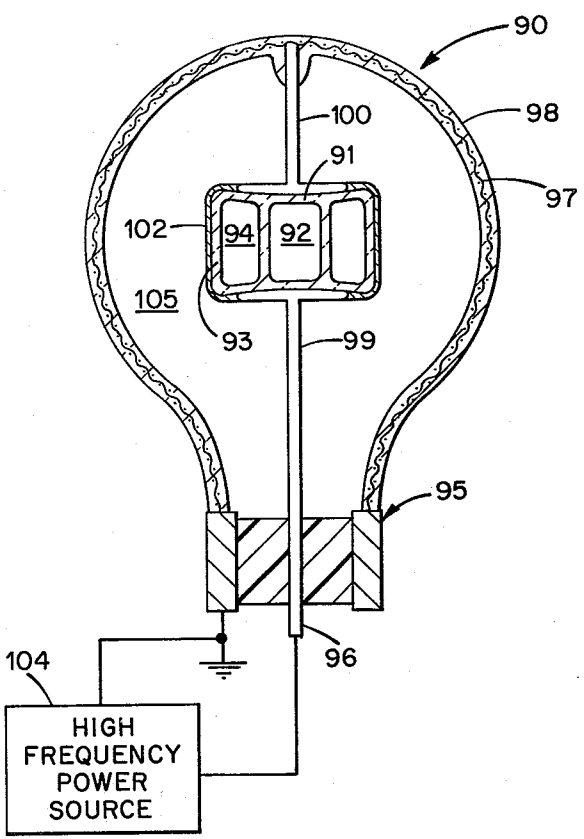
FIG. 5 is a schematic representation of another alternative form of an electrodeless fluorescent light source in accordance with the present invention.

Another embodiment of the present invention is illustrated in FIG. 5. The apparatus 90 includes an electrodeless lamp 91 having an inner envelope enclosing a fill material 92 of a metal iodide and a buffer gas or of iodine. The envelope of the lamp 91 is encircled by an intermediate sealed envelope 93 of a substance which is transparent to ultraviolet and visible light. The intermediate envelope 93 is contiguous with the inner envelope and defines therewith an annular region 94 encircling the lamp 91. The annular region 94 contains a gaseous phosphor material as described hereinabove. An RF coupling fixture 95 includes an inner conductor 96 and an outer conductor 97 which is supported in an outer envelope 98 of a material transparent to visible light. The electrodeless lamp 91 together with the intermediate envelope 93 are supported on electrodes 99 and 100 from the inner and outer conductors, respectively. RF power is applied to the conductors 96 and 97 through a coaxial arrangement to a high frequency power source 104. The space 105 between the intermediate envelope 92 and the outer envelope 98 contains a vacuum or an inert gas. A coating of solid phosphor material 102 is adherent to the outer surface of the intermediate envelope 93. When high frequency power is applied to the electrodeless lamp 91, the fill material therein emits ultraviolet radiation. The ultraviolet radiation photoexcites the gaseous phosphor material in the space 94 and it emits visible light. Not all of the ultraviolet radiation is absorbed by the gases in the space 94. Some of the ultraviolet radiation passes through the intermediate envelope 93 to impinge on the solid phosphor material 102, which in turn also emits visible light.

Figure 6:
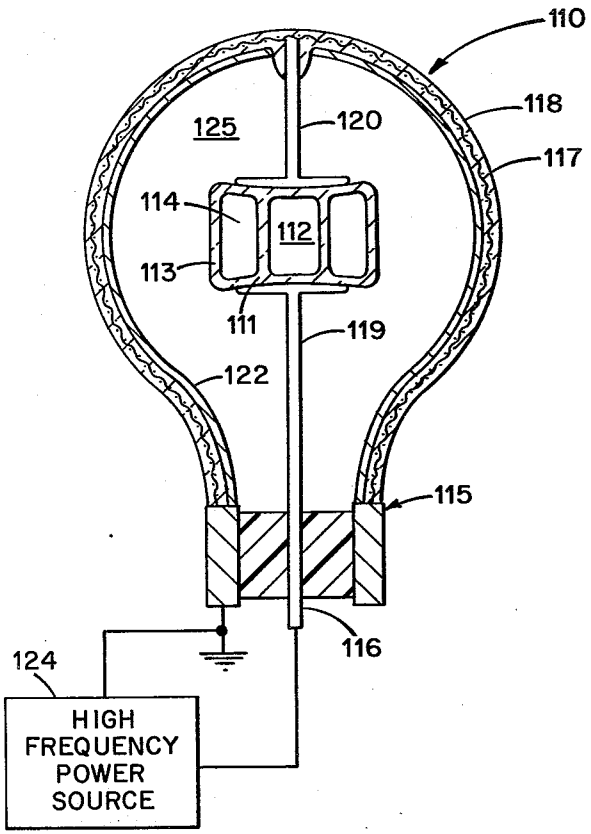
FIG. 6 is a schematic representation of a modification of the alternative form of FIG. 5.

FIG. 6 illustrates a modification of the embodiment of FIG. 5. The apparatus 110 includes an electrodeless lamp 111 having an inner envelope enclosing a fill material 112 of a metal iodide and an inert buffer gas or of iodine. An intermediate envelope 112 encircles the lamp 111 to form an annular region 114 which contains a gaseous phosphor material. An RF coupling fixture 115 includes an inner conductor 116 and a conductive mesh outer conductor 117 contained in an outer envelope 118. The combination of the electrodeless lamp 111 and intermediate envelope 112 are supported by electrodes 119 and 120 from the inner and outer conductors, respectively. RF power is applied to the conductors 116 and 117 through coaxial connections to a high frequency power source 124. The space 125 between the intermediate envelope 112 and the outer envelope 118 contains a vacuum or an inert gas. A coating of solid phosphor material 122 is adherent to the inner surface of the outer envelope 118. When high frequency power is applied to the electrodeless lamp 111, the fill material therein emits ultraviolet radiation. The ultraviolet radiation photoexcites the gaseous phosphor material in the space 114 and it emits visible light. Not all of the ultraviolet radiation is absorbed by the gases in the spaces 114. Some of the ultraviolet radiation passes through the intermediate envelope 113 and the space 125 to impinge on the solid phosphor material 122, which in turn also emits visible light.

Thus, there is provided electromagnetic discharge apparatus which serves as an electrodeless fluorescent light source. The apparatus employs an electrodeless lamp as described in the aforementioned application of Proud and Johnson as a source of ultraviolet radiation and fluorescing material arranged to convert the ultraviolet radiation to visible light.

While there has been shown and described what are considered preferred embodiments of the present invention, it will be obvious to those skilled in the art that various changes and modifications may be made therein without departing from the invention as defined by the appended claims.

What is claimed is:

1. An electromagnetic discharge apparaus comprising
an electrodeless lamp having an inner envelope of a substance transparent to ultraviolet radiation enclosing a fill material selected from the group consisting of a metal iodide together with an inert buffer gas and iodine;
means for coupling high frequency power to the fill material within the inner envelope to vaporize and excite the fill material producing ultraviolet radiation;
an outer envelope of a substance transparent to visible light surrounding said inner envelope and spaced therefrom; and
fluorescing material which emits visible light upon absorption of ultraviolet radiation disposed between the outer surface of the inner envelope and the inner surface of the outer envelope.

2. An electromagnetic discharge apparatus in accordance with claim 1 wherein
said fluorescing material comprises a gaseous phosphor material located in the space between the outer surface of said inner envelope and the inner surface of said outer envelope.

3. An electromagnetic discharge apparatus in accordance with claim 1 wherein
said fluorescing material comprises a solid phosphor material adherent to the outer surface of said inner envelope.

4. An electromagnetic discharge apparatus in accordance with claim 1 wherein
said fluorescing material comprises a solid phosphor material adherent to the inner surface of said outer envelope.

5. An electromagnetic discharge apparatus in accordance with claim 1 wherein
said fill material consists essentially of a metal iodide selected from the group consisting of cadmium iodide and mercuric iodide, and an inert buffer gas.

6. An electromagnetic discharge apparatus in accordance with claim 1 wherein
said fill material consists essentially of iodine.

7. An electromagnetic discharge apparatus comprising an electrodeless lamp having an inner envelope of a substance transparent to ultraviolet radiation enclosing a fill material selected from the group consisting of a metal iodide together with an inert buffer gas and iodine;

an outer envelope of a substance transparent to visible light surrounding said inner envelope and spaced therefrom;

a coupling fixture having an inner conductor and an outer conductor encircling the inner conductor;

the conductors having means at one end adapted for coupling to a high frequency power source and means at the other end coupled to said electrodeless lamp so that said electrodeless lamp forms a termination load for the coupling fixture and emits ultraviolet radiation when high frequency power is applied to said coupling fixture; and fluorescing material which emits visible light upon absorption of ultraviolet radiation disposed between the outer surface of said inner envelope and the inner surface of said outer envelope.

8. An electromagnetic discharge apparatus in accordance with claim 7 wherein said fluorescing material comprises a gaseous phosphor material located in the space between the outer surface of said inner envelope and the inner surface of said outer envelope.

9. An electromagnetic discharge apparatus in accordance with claim 7 wherein said fluorescing material comprises a solid phosphor material adherent to the outer surface of said inner envelope.

10. An electromagnetic discharge apparatus in accordance with claim 7 wherein said fluorescing material comprises a solid phosphor material adherent to the inner surface of said outer envelope.

11. An electromagnetic discharge apparatus in accordance with claim 7 wherein said fill material consists essentially of a metal iodide selected from the group consisting of cadmium iodide and mercuric iodide, and an inert buffer gas.

12. An electromagnetic discharge apparatus in accordance with claim 7 wherein said fill material consists essentially of iodine.

13. An electromagnetic discharge apparatus in accordance with claim 7 further including a source of high frequency power at a frequency between 1 MHz and 10 GHz coupled to said means at the one end of the conductors of the termination fixture.

14. An electromagnetic discharge apparatus comprising an electrodeless lamp having an inner envelope of a substance transparent to ultraviolet radiation enclosing a fill material;

an outer envelope of a substance transparent to visible light surrounding said inner envelope and spaced therefrom;

a coupling fixture having an inner conductor and an outer conductor encircling the inner conductor;

the conductors having means at one end adapted for coupling to a high frequency power source and means at the other end coupled to said electrodeless lamp so that said electrodeless lamp forms a termination load for the coupling fixture;

the fill material being selected from the group consisting of a source of iodine atoms which are excited to a high energy state when high frequency power is applied to said coupling fixture and which emit ultraviolet radiation by photon emission transition to a lower energy state together with an inert buffer gas, and a source of iodine atoms which are excited to a high energy state when high frequency power is applied and which emit ultraviolet radiation by photon emission transition to a lower energy state; and fluorescing material which emits visible light upon absorption of ultraviolet radiation disposed between the outer surface of said inner envelope and the inner surface of said outer envelope.

15. An electromagnetic discharge apparatus in accordance with claim 14 wherein said fluorescing material comprises a gaseous phosphor material located in the space between the outer surface of said inner envelope and the inner surface of said outer envelope.

16. An electromagnetic discharge apparatus in accordance with claim 14 wherein said fluorescing material comprises a solid phosphor material adherent to the outer surface of said inner envelope.

17. An electromagnetic discharge apparatus in accordance with claim 14 wherein said fluorescing material comprises a solid phosphor material adherent to the inner surface of said outer envelope.

18. An electromagnetic discharge apparatus comprising an electrodeless lamp having an envelope of a light transmitting substance enclosing a fill material selected from the group consisting of a metal iodide together with an inert buffer gas and iodine;

means for coupling high frequency power to the fill material within the envelope to vaporize and excite the fill material producing ultraviolet radiation; and a coating of solid phosphor material which emits visible light upon absorption of ultraviolet radiation adherent to the surface of said envelope.

19. An electromagnetic discharge apparatus in accordance with claim 18 wherein said fill material consists essentially of a metal iodide selected from the group consisting of cadmium iodide and mercuric iodide, and an inert buffer gas.

20. An electromagnetic discharge apparatus in accordance with claim 18 wherein said fill material consists essentially of iodine.

21. An electromagnetic discharge apparatus comprising an electrodeless lamp having an inner envelope of a substance transparent to ultraviolet radiation enclosing a fill material selected from the group consisting of a metal iodide together with an inert buffer gas and iodine;

an intermediate envelope of a substance transparent to visible light enclosing a region encircling said inner envelope and contiguous therewith;

an outer envelope of a substance transparent to visible light surrounding said intermediate envelope and spaced therefrom;

a coupling fixture having an inner conductor, and an outer conductor encircling the inner conductor;

an outer envelope of a substance transparent to visible light surrounding said intermediate envelope and spaced therefrom;

the conductors having means at one end adapted for coupling to a high frequency power source and means at the other end coupled to said electrodeless lamp so that said electrodeless lamp forms a termination load for the coupling fixture and emits ultraviolet radiation when high frequency power is applied to said coupling fixture; and fluorescing material comprising gaseous phosphor material which emits visible light upon absorption of ultraviolet radiation located in said region encircled by said intermediate envelope.

22. An electromagnetic discharge apparatus in accordance with claim 21 wherein said intermediate envelope is of a substance which is also transparent to ultraviolet radiation; and further including fluorescing material comprising a solid phosphor material which emits visible light upon absorption of ultraviolet radiation adherent to the outer surface of said intermediate envelope.

23. An electromagnetic discharge apparatus in accordance with claim 21 wherein said intermediate envelope is of a substance which is also transparent to ultraviolet radiation;

and further including fluorescing material comprising a solid phosphor material which emits visible light upon absorption of ultraviolet radiation adherent to the inner surface of said outer envelope.

* * * * *